United States Patent [19]

Vogen

[11] Patent Number: 4,574,888

[45] Date of Patent: Mar. 11, 1986

[54] METHOD AND APPARATUS FOR REMOVING STUCK PORTIONS OF A DRILL STRING

[75] Inventor: Wayne V. Vogen, Oakland, Calif.

[73] Assignee: URS Corporation, San Mateo, Calif.

[21] Appl. No.: 637,385

[22] Filed: Aug. 2, 1984

Related U.S. Application Data

[63] Continuation-in-part of Ser. No. 505,254, Jun. 17, 1983, abandoned.

[51] Int. Cl.[4] ..... E21B 31/107

[52] U.S. Cl. ..... 166/301; 166/53; 166/65.1; 166/177; 175/56

[58] Field of Search ..... 166/301, 53, 98, 277, 166/65 R, 72, 177; 175/56, 55; 254/29 R; 294/86.1, 86.15; 405/240, 243, 232

[56] References Cited

U.S. PATENT DOCUMENTS

| | | | |
|---|---|---|---|
| 2,972,380 | 2/1961 | Bodine, Jr. | 166/301 |
| 3,004,389 | 10/1961 | Müller | 175/56 |
| 3,262,507 | 7/1966 | Hansen | 175/56 |
| 4,236,580 | 12/1980 | Bodine | 166/301 |

*Primary Examiner*—James A. Leppink

*Assistant Examiner*—Hoang C. Dang

*Attorney, Agent, or Firm*—Owen, Wickersham & Erickson

[57] ABSTRACT

Method and apparatus for recovering a stuck element from deep in a well. The lower end of an elastic steel column is attached to the upper end of the stuck element. The upper end of the column extends above the top of the well and is attached to a reaction mass lying vertically thereabove through (1) an accelerometer and then (2) vertically mounted compression springs in parallel with a vertically mounted servo-controlled hydraulic cylinder-piston assembly. A substantially constant upward load is applied to the reaction mass, and the piston of the hydraulic assembly is reciprocated under servo control to apply vertical vibration to the upper end of the column. This vertical vibration is adjusted through the servo control to an appropriate resonant frequency for the column in the range of ½ Hz to 25 Hz, and the frequency is maintained at resonance by a feedback system relying on maintaining a phase difference of 90° between a displacement signal developed from the accelerometer and a pressure-differential signal related to the pressure difference between the opposite sides of the piston.

15 Claims, 9 Drawing Figures

FIG. 5
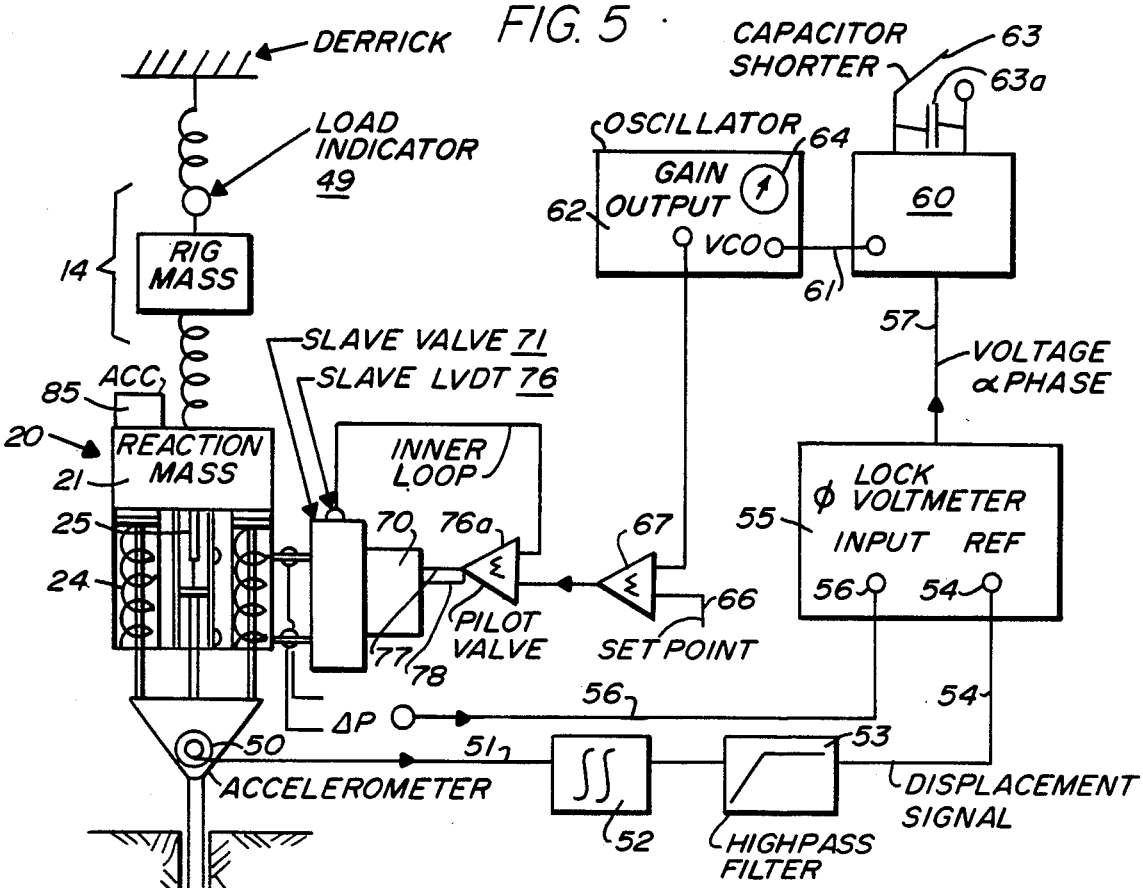
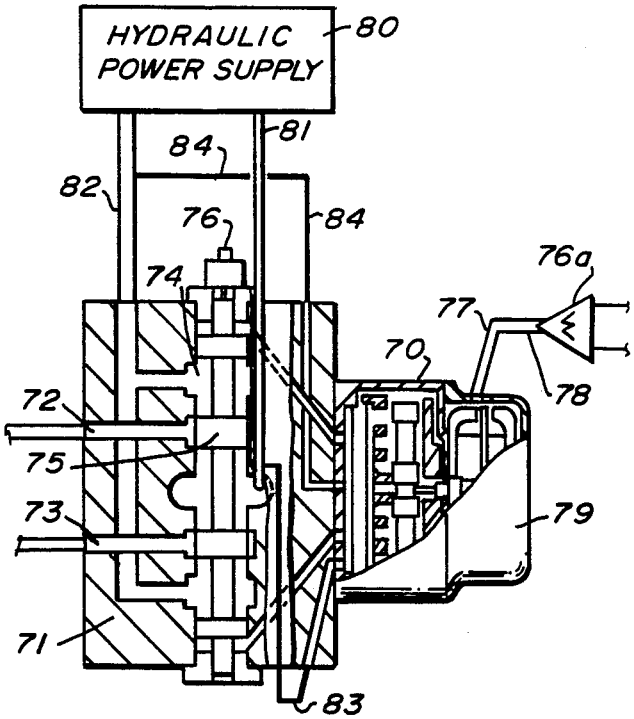
FIG. 6

METHOD AND APPARATUS FOR REMOVING STUCK PORTIONS OF A DRILL STRING

REFERENCE TO RELATED APPLICATION

This application is a continuation-in-part of application Ser. No. 505,254, filed June 17, 1983 now abandoned.

This invention relates to method and apparatus for retrieving stuck drill bits, liners etc. from oil wells.

BACKGROUND OF THE INVENTION

The need for sometimes removing objects which have become tightly lodged in oil wells has been known for a long time. Such objects include, inter alia stuck drill bits, liners, casing, and pumps.

One commonly used technique has involved pulling on the drill-string with a static or slowly varying force, in order to overcome the static friction or tractive force holding the particular object in the drill hole. Many tools can be used to develop large static tensional loads in the drill string, usually in conjunction with the oil well derrick. Unfortunately, the purely static technique often requires forces so great as to induce yielding, or even failure, in the drill string when trying to free the stuck object. If the safe working stress has been exceeded, then the entire drill string must be removed and inspected, and possibly replaced, at great expense and loss of drilling production time.

A second technique employs a vibrator to excite vibratory motion in the drill string (and attached stuck object) at or near one of its longitudinal resonant frequencies while pulling upward on the string. Examples of this technique are shown in Bodine's U.S. Pat. Nos. 2,972,380 and 4,236,580.

The Bodine patents appear to be somewhat theoretical, since no specific examples are given. The frequencies appear to be thought of as within the sonic range. The vibrations are generally produced by rotary eccentric masses, sometimes driven by hydraulic motors.

Resonant dynamic excitation does offer significant advantages over the simple static-force approach to removal of lodged objects:

(1) In the case of adhesion to the hole, small cyclic movement can, as the Bodine patents point out, heat the adhesive material (e.g., tars or other long-chain polymers), thus decreasing its viscosity and, hence, the tractive force to be overcome;

(2) cyclic longitudinal force in the drill string was known by Bodine to produce a varying radial expansion and contraction in the string, which helps to overcome the traction;

(3) the cyclic force, as I have recently discovered can be concentrated in the uppermost part of the stuck object, thereby increasing the local stress needed to overcome traction. Thereby, the use of resonant dynamic loading in conjunction with static tension can lower the total stress required to free the stuck object. This, in turn, can reduce the likelihood of damaging the drill string, while improving the likelihood of successfully removing the stuck object.

In a system which is controlled by the power input (e.g., the rotational speed of an engine), a potential "runaway" situation exists, for when the maximum power input for a particular resonance is exceeded, the engine may speed up greatly because the pipe can absorb less power at a frequency higher than resonance. This problem will be explained below in more detail.

Another potential problem is that of exciting harmful modes of vibration of the derrick. Modes of vibration which have a lower resonant frequency than the desired mode and which involve different parts of the derrick and support structure, have large and potentially harmful vibrational amplitudes. A system which increases the operating frequency to arrive at the desired mode tends to excite these harmful modes and create hazardous conditions.

Among the objects of the invention are these: to provide a practical and economic method for driving the drill pipe or string at resonance; to keep it at resonance when and if the resonant frequency changes; to provide for relatively low power operation; to provide controls that protect the apparatus from damaging itself; and to provide for pulses, when needed, to aid freeing the stuck object.

SUMMARY OF THE INVENTION

The invention has both method and apparatus aspects.

The method of the invention is that of recovering a stuck element from deep in a well. It begins by attaching the lower end of an elastic steel column to the upper end of the stuck element. The upper end of the column extends to and above the top of the well. To this upper end of the column is attached a reaction mass vertically thereabove, the attachment being made through a vertically mounted servo-controlled hydraulic cylinder-piston assembly.

The method next calls for applying a substantially constant upward load to the reaction mass, and simultaneously reciprocating the piston of the hydraulic cylinder under servo control to apply vertical vibration to the upper end of the column. This vertical vibration is continually adjusted through the servo control to an appropriate resonant frequency for the column, in the range of $\frac{1}{2}$ $H_Z$ to 25 $H_Z$, the resonance being maintained by the application of electrical feedback from an accelerometer rigidly connected to the top of the column. A displacement signal is produced by double integration of a signal from the accelerometer.

The apparatus includes a reaction mass, vertically mounted compression springs and, in parallel with the springs, a vertically mounted hydraulic cylinder-piston assembly, which connects the reaction mass to the column. The lifting block is attached to the upper end of the reaction mass by suitable apparatus and supports and applies a vertical load to the reaction mass.

A servo-control system for the hydraulic cylinder-piston assembly simultaneously reciprocates the piston to apply vertical vibration to the upper end of the column, and feedback apparatus continually adjusts the servo-control to cause the assembly to seek and maintain an appropriate resonant frequency for the column, in the range of $\frac{1}{2}$ $H_Z$ to 25 $H_Z$.

Other features of the invention, as well as other objects and advantages will be described below.

BRIEF DESCRIPTION OF THE DRAWINGS

FIG. 5 is a block diagram of the servo-control and feedback system utilized to seek and maintain resonance.

FIG. 6 is an enlarged diagrammatic view of a portion of FIG. 5 representing a slave system and related members.

DESCRIPTION OF A PREFERRED EMBODIMENT

Figure 1:
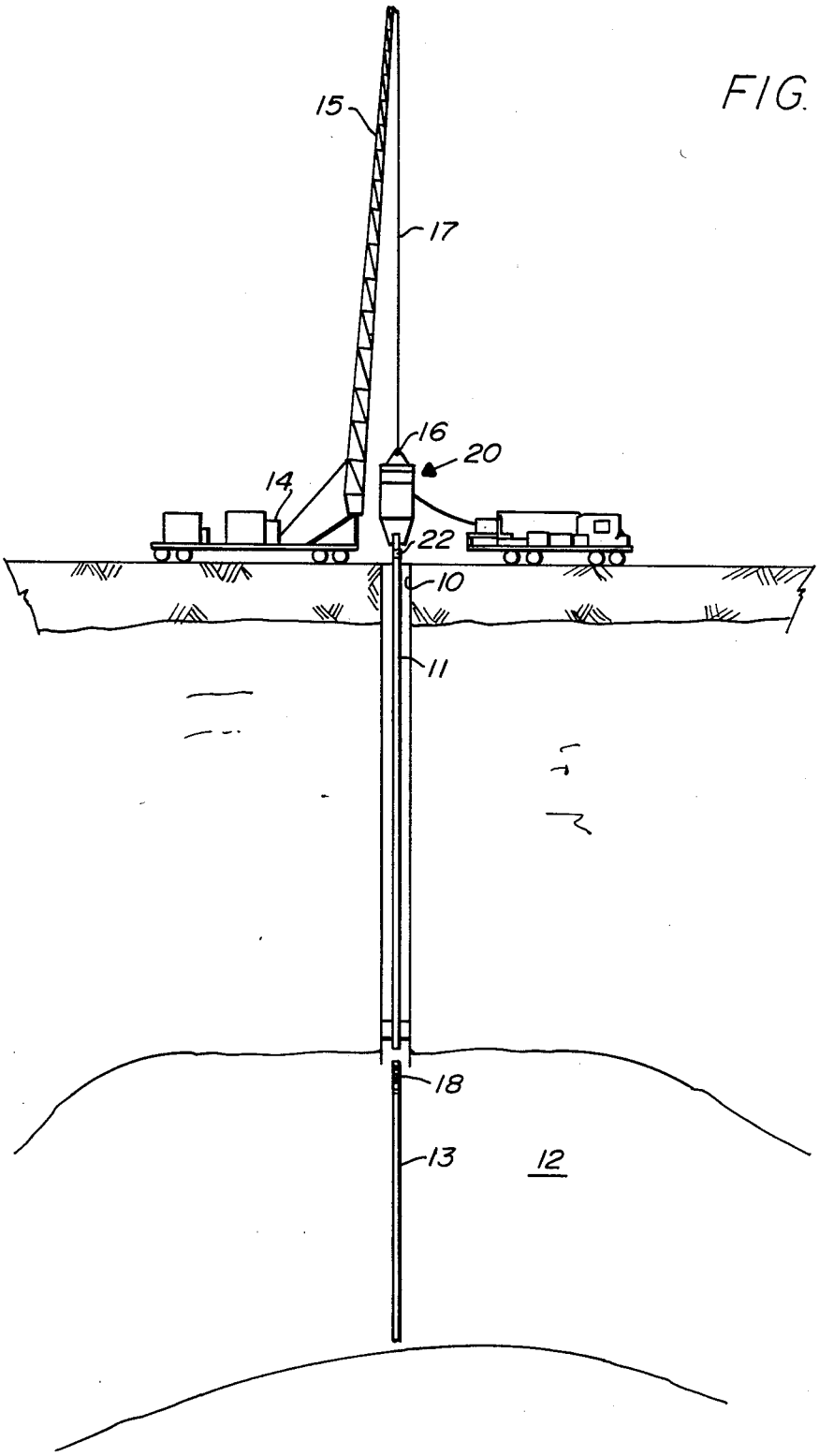
FIG. 1 is a simplified view in elevation and in section of apparatus embodying the principles of this invention applied to remove a stuck liner from the oil sand region of an oil well.

FIG. 1 shows an oil well 10 with pipe, i.e., a drill line 11, leading down to a deposit 12 of oil sand, in which a liner 13 has become stuck. According to the present invention, a typical procedure for removing the stuck drill-hole liner 13 may include setting up a well workover ring 14 including a suitable derrick 15 with a shackle or block or hook 16 suspended on a cable 17, and attaching the appropriate pipe or drill string 11 to the liner 13 by means of a conventional fishing tool 18. Then a shaker or vibrator system 20 is attached to the top of the drill string 11.

Figure 2:
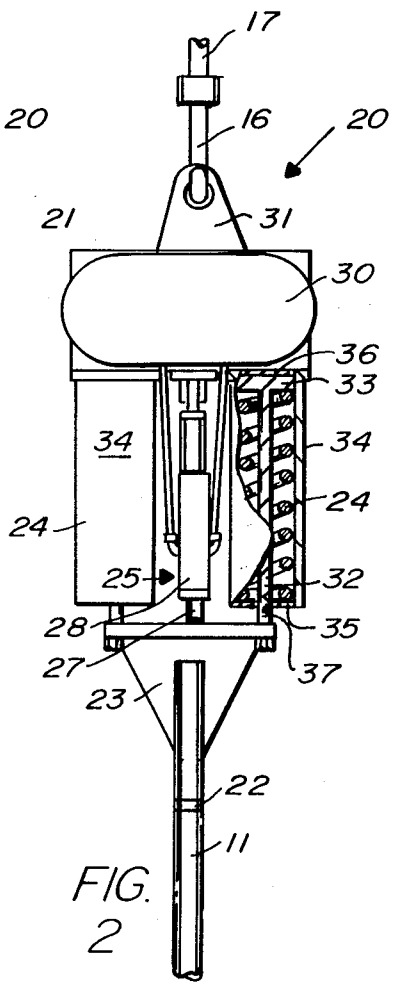
FIG. 2 is a fragmentary enlarged view in front elevation of the vibratory apparatus of FIG. 1 connecting the top of the drill rod to a reaction mass.
Figure 3:
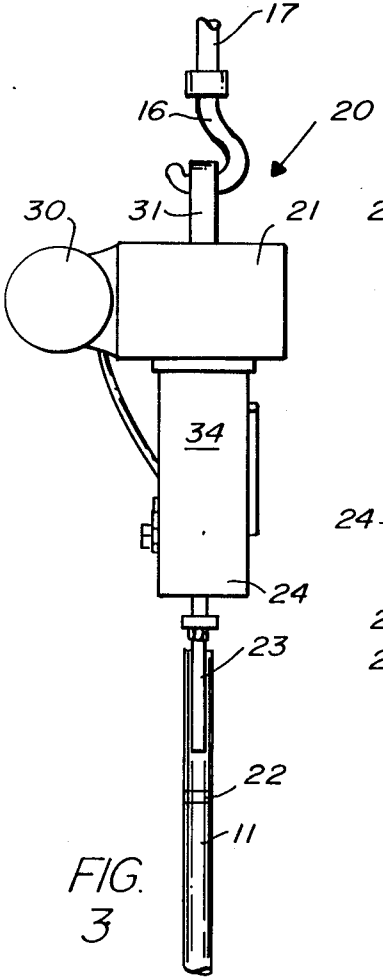
FIG. 3 is a view in side elevation of the assembly of FIG. 2.

The shaker system 20, shown in more detail in FIGS. 2 and 3, includes a reaction mass 21 held by the hook 16 (or a conventional shackle), to which a powerful lifting force, e.g., between 30,000 and 100,000 pounds, is applied constantly through the cable 17 during the operation. The lifting force depends upon the depth of the well, about 100,000 pounds being used for a well 2500 feet deep and 40,000 pounds for a 1000-foot well. The upper end of the drill rod 11 is connected, as by a fitting 22, threaded or clamped to engage the threads at the upper end of the drill rod 11, to a junction plate 23. A pair of compression springs 24 form a connection between the junction plate 23 and the reaction mass 21, in parallel with a hydraulic cylinder-piston assembly 25, in which the piston not shown may be connected by a rod 27 to the junction plate 23, while the cylinder 28 is connected to the reaction mass 21.

An accumulator 30 is secured to and becomes part of the reaction mass 21, providing additional mass. The main reaction mass 21 may be a thick steel box filled with lead bricks and having a lifting eye 31 for attachment to the hook 16. The reaction mass 21 thus provides a nearly rigid structure for the hydraulic assembly 25 to work against. In addition, it greatly attenuates the motion imparted to the drill pipe 11 so as effectively to isolate the well derrick 15 from the large movements provided by the hydraulic cylinder-piston assembly 25.

The springs 24 are connected in parallel with the hydraulic assembly 25 to support the static load of the weight of the drill string 11 and the pull exerted by the derrick 15 through the lifting block 16. The springs 24 are flat-end compression springs, each of which has a rod 32 through its center terminating in a bearing 33, so that the springs 24 behave like extension springs. The spring 24, rod 32, and bearing 33 are contained in a steel tube 34 with a lower end 35 against which the spring 24 bears, and the upper end 36 of the tube 34 is connected to the bottom of the reaction mass 21. The rod 32 extends out through an opening provided with a bearing 37 in the lower end 35 of the tube 34 and is connected to the junction plate 23.

The springs 24 are sized with respect to length and stiffness so as to be at or near mid-deflection under the range of static loads encountered while freeing the stuck object 13. The static load is generally the combination of the weight of the drill pipe 11 in the hole and the pull exerted by the rig 14 in lifting the shaker system 20. This assures that the elastic pipe column 11 will always be in tension, thereby preventing Euler buckling of the drill string 11.

Figure 4:
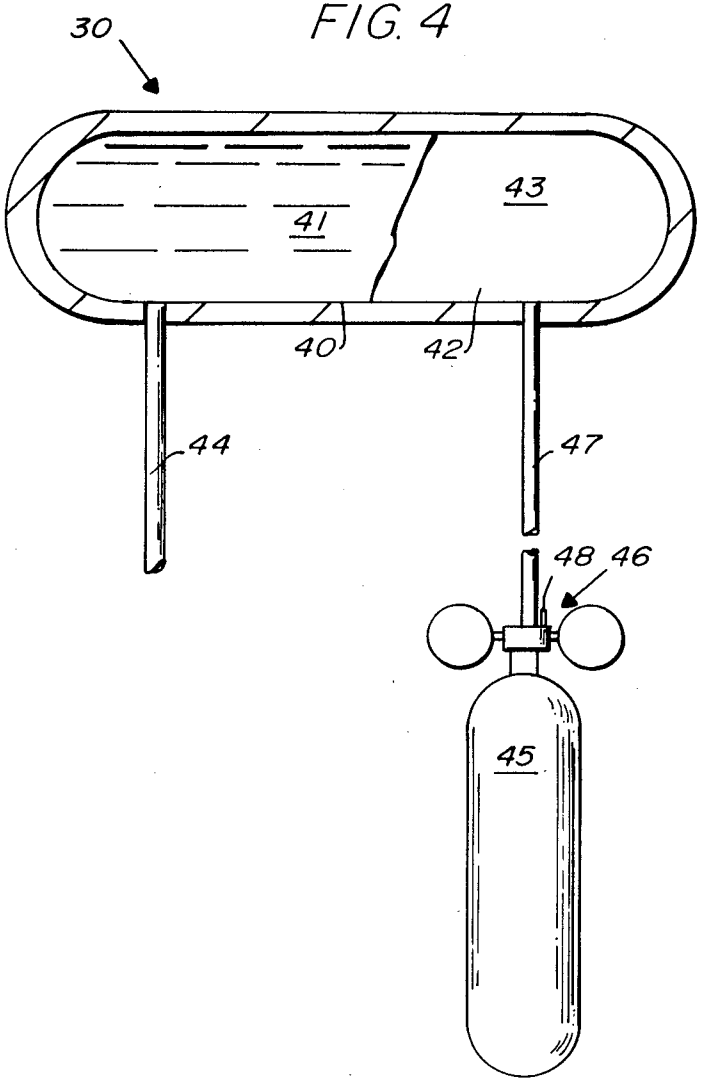
FIG. 4 is a view in elevation and partly in section of the accumulator of FIGS. 2 and 3 and its related parts, through which sharp pulses and high level transient boosts in output power may be applied to the drill rod of FIG. 3.

During the set-up period, a hydraulic pump 80 (FIG. 6) is operated to store pressurized hydraulic fluid in the accumulator 30 at about 3000 p.s.i. The hydraulic accumulator 30 is a pressure vessel which contains a piston or inner expandable container 40 for hydraulic fluid 41 and an outer container or bladder 42 filled with nitrogen gas. As shown in FIG. 4, the accumulator 30 has a conduit 44 leading from the bag 40 to the hydraulic cylinder 28. The bladder 42 is supplied with nitrogen gas 43, when desired, by a high-pressure (e.g. 5,000 p.s.i.) nitrogen supply cylinder 45, via a regulator 46 and a conduit 47. A bleed valve 48 is provided to relieve the pressure in the bladder 42 as desired.

Figure 7:
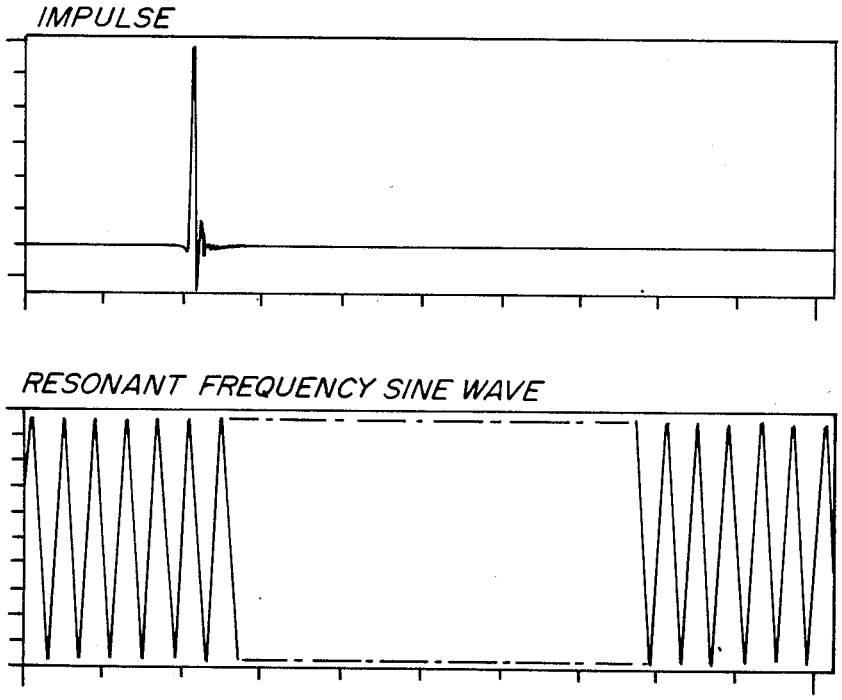
FIG. 7 is a pair of graphs indicating how pulses are added to the resonant-frequency for applying an extra momentary force to the liner.

The accumulator 30 serves three purposes. First, it reduces the pressure drop caused by the flexibility of the supply hose 44 which leads from the hydraulic pump 38 to the hydraulically cylinder 28. Second, it provides an energy storage medium in which high-pressure hydraulic fluid 41 can be accumulated (hence its name) before the commencement of excitation of the drill pipe 11. Third, by introducing nitrogen gas 43 into the bladder 42 at pressure higher than that of the pressurized hydraulic fluid 41, the system power output can be given a transient boost for freeing the stuck object 13 when the normal operating pressure is not sufficient to overcome the binding and adhesive forces. The effect of this transient boost or momentary pulse is shown in FIG. 7 where the pulse at the top is added to the resonant pattern at the bottom of FIG. 7.

After pressurization of the accumulator 30 the shaker 20 may be actuated and driven (by apparatus to be described below) at a power level which can cause significant heating in the uppermost portion of the bound liner 13. This level of vibration may free the liner 13 through the combined effects of heating of the oil sand 12 adjacent to it and by longitudinal and radial motion. If required, high pressure nitrogen gas from the cylinder 45 can be injected into the accumulator bladder 42 to give a short burst of increased excitation to provide additional force acting to free the liner 13.

The invention has been used successfully to remove 150 foot liners from 950 foot deep oil wells by vibrating 800 foot of 4½ inch outside diameter drill pipe at 12 Hertz. The amplitude of oscillation of the top of the pipe was approximately 3.2 inches peak to peak, when the applied force was 11,000 pounds peak. The power applied to the liner was then;

$$\text{Power} = \text{Force} \cdot \text{Velocity} = F \cdot X \cdot W = F \cdot X \cdot 2\pi f$$

$$P = \frac{11{,}000 \text{ lbs peak } (0.707 \text{ RMS/peak})(3.2 \text{ in ptop}) \cdot 2 \cdot \pi 12 \text{ Hz } \frac{0.707}{2} \text{ RMS ptop}}{12 \text{ in/ft}}$$

$$P = 55.3 \times 10^3 \frac{\text{ft. lbs}}{\text{sec}} = 100.5 \text{ hp}$$

An important feature of this invention is that the drill pipe 11 is driven at resonance by a servo-hydraulic system 50 acting on the hydraulic assembly 25, operated in a feedback control mode. This is the most practical and economic method known to the inventor for accomplishing the needed resonant drive. Feedback control guarantees that the system is always driven exactly at resonance, thereby producing the maximum force for loosening the stuck object.

Servo-controlled hydraulic cylinders are used in large numbers in numerous industries, unrelated to the stuck tool removal field, so that low cost, high reliability, and accuracy are readily obtainable. Therefore, the present system can be less expensive and more reliable and accurate than other possible methods of exciting the pipe 11 connected to the stuck object 13. Servo-controlled hydraulic cylinders are primarily used in a resonant configuration for material testing, where the benefit of resonance decreases the power and size of the actuator required to achieve a large number of stress cycles in the object under test. They have not been used heretofore in a system like that of this invention.

Because the frequency of excitation of a servo-hydraulic system is locked to the resonant frequency of the pipe, changes in the amount of applied power changes only the force at the bound position.

A typical static force level applied by the derrick 15 to the top of the reaction mass 21 in the previously mentioned 950 foot oil well was 30,000 pounds. A load indicator 49 (FIG. 5) which measures the tension or load in the fixed end of the lifting cable 17, produces the first indication that the liner 13 is beginning to be freed. The sensitive needle on the load meter 49 will begin to indicate a decrease in load as the liner 13 starts to move upward. The derrick operator endeavors to hold the static load constant while the resonant excitation overcomes the forces confining the liner 13. The combination of the upward static load and the resonant vibration extracts the stuck liner 13.

FIG. 5 shows, somewhat diagrammatically, a controller or control system that may be employed to maintain the elastic pipe 11 and the free portion of the liner 13 in longitudinal resonance. An accelerometer 50 is attached to the top of the elastic column 11 to measure the acceleration as referenced to ground 12, rather than to the reaction mass 21. The acceleration signal 51 from the accelerometer 50 is subsequently double-integrated electrically by a double integrator 52 and then filtered with a five-pole high-pass filter 53 to attenuate low frequency 1 by f noise. The 5-pole filter rolloff characteristic is down 5 db at 0.5 Hz. The resulting displacement signal 54 is very regular and is free from low-frequency noise. Other means of obtaining such a displacement signal which relates to the acceleration of the reaction mass 21 relative to the earth in which the well 10 is located, may be used, if desired.

The displacement signal 54 is used as the reference in a phaselock voltmeter 55 which detects the relative phase between a signal indicating pressure differential, ΔP, across the hydraulic cylinder-piston assembly 25, put into the voltmeter 55 as a signal 56 and the displacement signal 54. The ΔP signal 56 is a relatively pure sine wave during operation, but various factors such as the limited hydraulic supply pressure and pressure spikes distort the ΔP signal 56. At resonance, the displacement signal 54 and the ΔP signal 56 are 90° out of phase. The phaselock voltmeter 55 puts out a voltage 57 proportional to the relative phase between the displacement signal 54 and the ΔP signal 56. The voltage 57 is zero when the relative phase is 90°. The voltage 57 increases when the phase becomes greater than 90° and decreases when the phase is less than 90°. The phaselock voltmeter 55 has the ability to extract the sine wave component at the operating resonant frequency of the displacement and ΔP signals.

The voltage 57 is then sent to an integrator 60 and is electrically integrated. The output 61 of the integrator 60 is used as the voltage controlled oscillator (VCO) drive of a sine wave generator 62. The dc voltage output 61 of the integrator changes the frequency of the sine wave generator 62 to maintain resonance. The resonant frequency decreases as the liner 13 is freed, due to the resulting increase in the free length of the elastic column comprising the pipe 11 plus the freed portion of the liner 13.

The integrator 60 may be an operational amplifier with a capacitor feedback loop, and in this invention a switch 63 is placed across a capacitor **63*a* of the integrator 60 so that the capacitor 63*a* can be shorted, thereby causing the output of the integrator 60 to be set to zero, as when setting the frequency of the oscillator 62 at the calculated resonant frequency for the drill string. A gain knob 64 of the oscillator 62 is used to control the amplitude of vibration of the elastic column 11 plus the freed portion of the liner 13. Turning up the gain proportionally increases the sine wave output signal of the oscillator 62. This sine-wave output signal is added to a d.c. voltage 66 at a voltage summing device 67. The voltage 66 is called the set point and controls the neutral position of a pilot servo valve 70. The pilot valve 70 may have a spool which is maintained approximately in its central position in order to keep the pressure wave across the hydraulic cylinder 25** symmetrical.

FIG. 6 shows that a slave valve 71 is connected by ports 72 and 73 to the piston-cylinder assembly 25, these ports leading into a valve passage 74 in which a spool 75 moves, as determined by a slave LVDT 76. An adder or summing device **76*a* is connected to the summing device 67 and adds the signal from the valve 71 to that of the device 67. The output of the adder 76*a* is sent by lines 77 and 78 to control a motor 79 which operates the pilot valve 70**.

There is a hydraulic power supply 80 to supply fluid to the slave valve 71 via a conduit 81 and to receive fluid via a conduit 82. A pilot pressure conduit 83 is connected to the conduit 81, and a pilot return conduit is connected to the conduit 84.

The neutral operating position in the system is controlled by the rig operator and is maintained by keeping the tension constant by either raising or lowering the lifting block of the rig 14. The constant tension keeps the springs 24, which are parallel with the hydraulic cylinder 25, at a constant neutral position. The control system of FIG. 5 maintains the frequency precisely at resonance and the phase at $90° \pm 1°$.

I have found that previously available resonant control loops were not capable of maintaining the elastic column in a resonant condition. Previous systems employed an LVDT to derive an electrical signal proportional to relative displacement between the reaction mass 21 and the top of the elastic column. This system is appropriate when the reaction mass 21 is replaced by a rigid attachment to ground, but in my apparatus, the control system would amplify undesirable modes of vibration involving the rig 14 used to lift the vibrator.

The low-frequency position feedback of the normal control loop has been eliminated, because it counteracted the rig operator and effectively pushed the elastic column back down into the oil well 10 whenever the stuck liner 13 started to come free.

When the standard resonant control scheme was employed, such as one which utilized a zero crossing of the $\Delta P$ and displacement signals, the distortion and shifting of the $\Delta P$ signal caused the control system to drive the hydraulic shaker away from the resonant frequency and attendant phase.

In a vibration generating system which is controlled by the power input (e.g., the rotational speed of an engine), a potential "runaway" situation exists, for when the maximum power input for a particular resonance is exceeded the engine may speed up greatly, because the pipe can absorb less power at a frequency higher than resonance. The engine will have to speed up to the point where a value of power versus frequency of the engine equals a value of power versus frequency for the pipe. This problem will be explained below in more detail.

Figure 8:
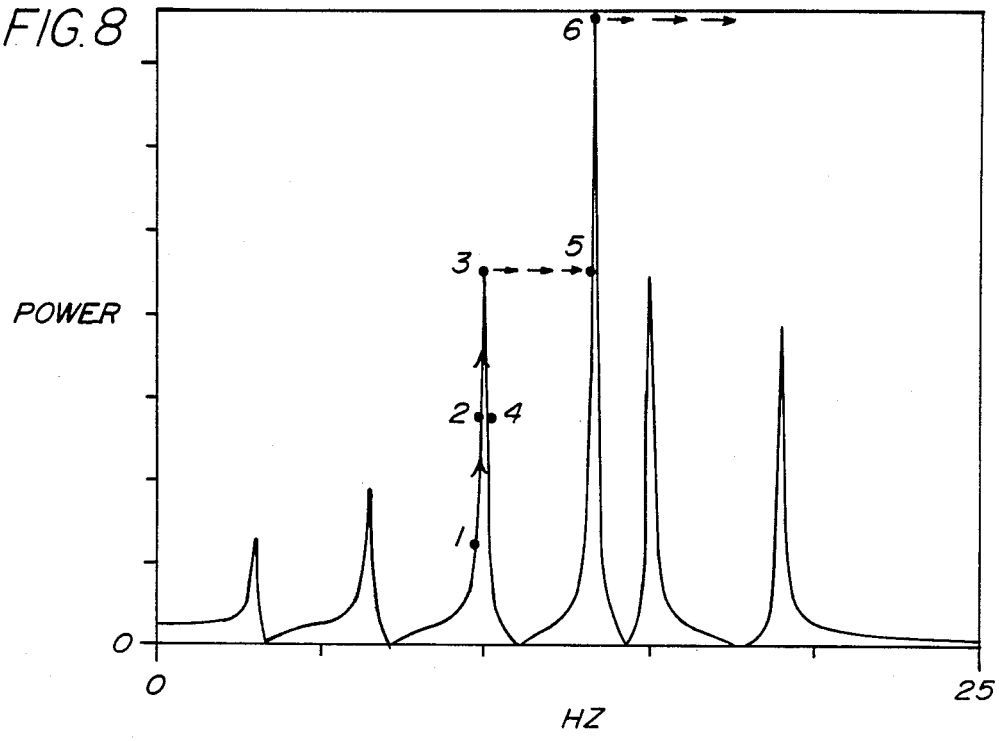
FIG. 8 is a power curve showing a series of peaks corresponding to different longitudinal modes of vibration of the pipe.

As an example, consider the power curve shown in FIG. 8, representing an undesirable prior-art system. The peaks in this power curve correspond to the different longitudinal modes of vibration of the pipe 11, with the higher-frequency modes having more nodes and antinodes. If the throttle of the drive unit or shaker 20 is originally set at 1, an increase in throttle would be required to move to 2; i.e., more power is required to drive the pipe 11 closer to the resonant frequency at 3. If the system is driven at exactly the resonant frequency corresponding to point 3, a small perturbation would cause the frequency to jump to point 5, since 4 is at a power level lower than 3. If the power delivered to the system at 3 is not sufficient to free the stuck object 13 and the throttle is then increased to 6, a small increase in throttle would cause a rapid increase in driving frequency, with the possibility of attendant damage. The danger of this runaway condition causes the operator to run such a vibrator at a power level below the maximum amount (5 instead of 6).

Operating the system at point 5 instead of point 6 not only reduces the amount of power applied to the stuck object but also results in the system not being operated at resonance. Point 6, or the peak of the power curve, is the resonant state of the elastic member. At resonance the spring force in the drill string is equal in magnitude and opposite in direction to the inertial force in the drill string, thereby canceling these reactive forces. The remaining dynamic force is the dissipative force caused by the friction holding the stuck object. This force is proportional to the velocity. Operating the system at a point on the power curve other than at resonance results in producing large forces in the system—larger than the dissipative force, which greatly increase the stress in the elastic member (i.e. drill pipe) and the vibrator. This large harmful force can over stress parts in the system and cause destructive failure.

In contrast, a servo-hydraulic system 20 such as is used in this invention holds the frequency constant, and avoids this problem. Indeed one can increase the usable power level so as to free the stuck object. The frequency controlled servo-hydraulic system operates as shown in FIG. 9.

Figure 9:
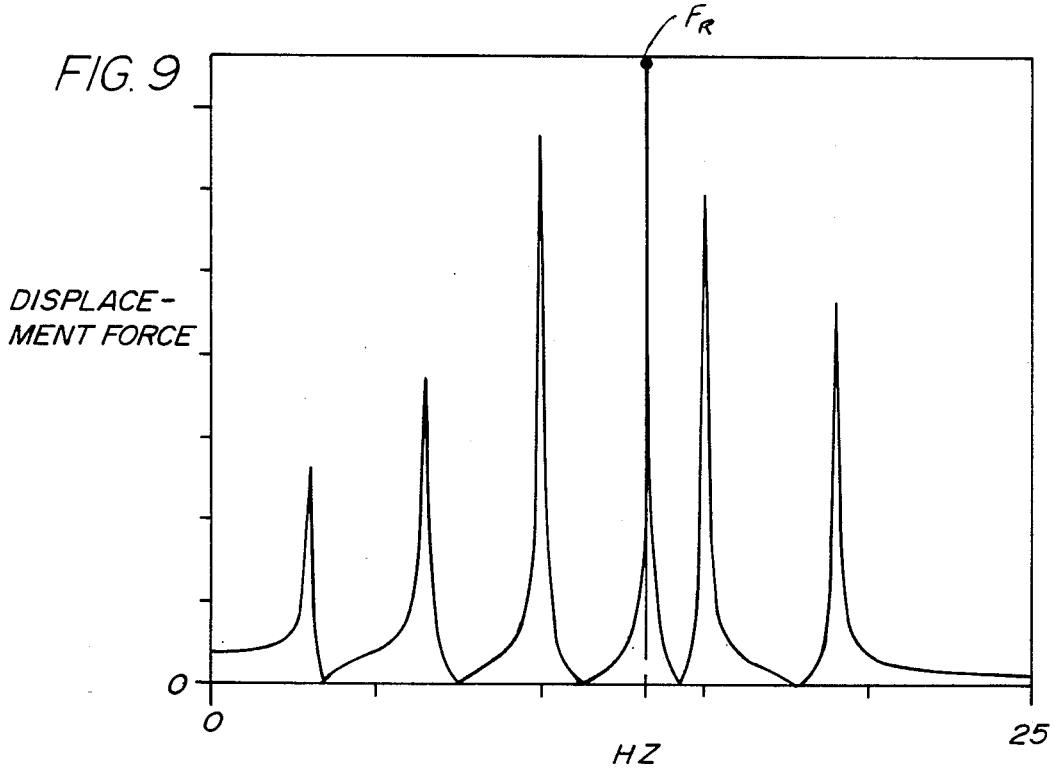
FIG. 9 is a similar view of the compliance or frequency-response curve for the drill string to which the power curve of FIG. 8 is applied.

FIG. 9 shows the compliance or frequency-response function for the longitudinal modes of vibration of the drill string 11. It represents the ratio of dynamic longitudinal displacement of a point on the pipe 11 to an input force. The servo-hydraulic system 50 is operated by choosing an appropriate resonant frequency, such as $f_r$ (see FIG. 9), and increasing the force to the level needed to overcome the tractive forces holding the stuck liner 13. An increase in force input by the hydraulic cylinder in this system increases only the vibratory amplitude in the pipe 11, not the frequency or the speed of operation. This is apparent by realizing that the operating speed is fixed at the resonant frequency by the feedback servo, as opposed to a system controlled by the power input. This feature allows the use of the accumulator 30 as a transient power booster, through the injection in the accumulator of high pressure nitrogen gas (which greatly enhances the effectiveness of the system). Moreover, the servo hydraulic system 50 never excites the harmful modes of vibration, which can excite the derrick enough to damage the ancillary equipment.

The curve in FIG. 9 is essentially independent of power level, consequently it can be determined at a very low, non-harmful level. Indeed, this is accomplished prior to applying enough power to loosen a stuck object. The modes which involve excess and damaging levels of vibration of the derrick and ancillary equipment are identified either experimentally or with the aid of a computer, at a power level which is safe. For example, an accelerometer 85 placed atop the reaction mass 21 can be used to indicate undue vibration and thereby identify a harmful mode. This is not possible with a rotating mass system because the power curve in FIG. 8 is unique to the particular system. This means that the harmful modes cannot be identified at low vibration (i.e., safe) levels and the power at the particular mode being excited may be inadequate to free the stuck object. In addition, the rotating mass exciter starts at some low frequency and is constrained to sweep through the harmful modes. The servo hydraulic system picks a useful mode, looks on to the mode and excites only that mode to a level required to free the stuck object.

Stuck objects 13 can be freed by vibratory loading within a short period of time, generally from one to five minutes. This allows the use of the hydraulic accumulator 30 to store the pressurized hydraulic fluid when the drill string 11 is not being excited, thereby greatly reducing the size of the hydraulic pump 80 required. In addition, the accumulator 30 can be pressurized, as stated above, with high pressure gas to provide a short, powerful boost of power to break loose the bound section.

Modern servo-hydraulic systems are thus well suited to the present invention, because their long-stroke cylinders eliminate the problem of impedance-matching the vibrator 20 to the drill string 11. Impedance-matching of rotating mass shakers to the item being vibrated is a significant problem because the force output is proportional to the frequency squared, while the mass and radius of rotating eccentric types of vibrations are usually fixed and cannot be changed readily. These factors are not a problem in hydraulic shakers.

A comparison of the different approaches will explain why: an eccentric mass shaker is fundamentally two counter rotating masses (2m) which are located at a radial distance r and rotated at an angular velocity (w).

The force produced by this action is:

$$F=2mrw^2 \sin wt.$$

In existing systems, the mass and radius are fixed, so that the driving force depends only on the square of the rotational speed. Since the force and speed are directly related, one cannot increase the force, if operating at or near the peak of a resonance, without risking a runaway situation, as described above. Each pipe or drill bit or liner 13 which is stuck will have its own dynamic characteristics, because the depth of the hole and the weight of the drill string 11 can vary greatly.

In the servo-hydraulic system used in this invention, the force and operating speed are independent; the applied force is related to the relative displacement of the piston and cylinder. Increasing the force while maintaining resonance is accomplished simply by a command to the servo-controller.

As the liner 13 is subjected to cyclic loading applied at its top, resistance to movement takes the form of shear stresses developed along the contact between the liner 13 and the oil bearing sands 12. The developed shear stresses at any depth are a function of the displacement of the liner 13 and increase in a roughly linear fashion up to the shear strength of the interface (Coyle, H. M., and Sulaiman, I. H., Skin Friction for Steel Piles in Sand, Proc. ASCE, Vol. 93, No. SM6, November 1967). Because the load is applied at the top of the liner 13 the load carried by the liner 13 will be greatest at its top and it must decrease to essentially zero at the bottom of the liner. The displacements of the liner 13 due to elastic stretching will therefore be greatest at the top and will diminish with depth. Thus the greatest shear stresses resisting movement of the liner 13 will initially be developed at the top, but as the shear strength is reached the liner 13 will move relative to the surrounding sands 12, and the full development of shear resistance will gradually move down the pile. However, because the fractional resistance provided by soils tends to decrease (1) with vibration (e.g. Youd, T. L. (1970), "Densification and Shear of Sand during Vibration," Proc. ASCE, Vol 96, No. SM3, May 1970, pp. 863–880) and (2) with large amplitude cyclic loading (e.g. Poulos, H. G., Cyclic Axial Pile Response—Alternative Analysis, Proc. ASCE Specialty Conference on Geotechnical Practice in Offshore Engineering, Austin, April 1983) the shear strength will tend to degrade, first at the top of the liner 13 where the cyclic displacements are greatest, thus transferring the center of resistance to movement further down the pile, and substantially at greater depths.

Thus, when an object is restrained along a significant length, an induced vibratory motion develops its greatest force in the uppermost portion of the stuck section 13. As the upper portion of this stuck section 13 is freed, the moving portion of pipe 11 becomes longer, thereby lowering the resonant frequencies of the pile 11. The servo-hydraulic control system automatically adjusts, due to the feedback signals, and keeps the system on the same resonant peak. A system which keeps the throttle setting at the level required to stay below the resonant peak can go into a runaway condition if the lower resonant frequency requires less power than the engine produces at that speed. This condition would cause the operator to run a rotating mass shaker at a frequency appreciably below the resonant peak, thereby reducing the power applied to free the stuck object.

Another advantage of employing the hydraulic shaker 20 to excite the pipe is that the modal displacement at the end of the pipe is not significantly reduced, because the mass or inertia of this shaker 20 is much smaller than that of other types. For example, compare the hydraulic system of this invention with a rotating-mass system.

In the hydraulic system used in this invention, the only added moving mass is that of the springs 24, the junction plate 23 and the piston of the hydraulic cylinder 28. This mass is negligible when compared to that of the pipe 11 which is being excited. Therefore deflection of the pipe end is not appreciably reduced. The only change required to increase the cyclic force is an increase in the hydraulic pressure.

In a rotating-mass system, the added mass is comprised (typically) of two counter-rotating masses, the support structure, and the moving part of the vibration isolator. The additional mass in the counter-rotating-mass system reduces deflection by a considerable amount, a difficult effect to overcome. Consideration of the driving force applied to the top end of the pipe will explain why this is so.

The total force that a rotating-mass shaker would apply to the end of the pipe 11 is $$F_T=2F=2mrw^2-2ma$$

where

F=the force applied by each mass m
m=mass of each of the two counter-rotating masses
a=acceleration of those masses
r=radius of rotation
w=angular velocity As explained previously, one particular mode is optimum because of impedance-matching considerations. This fact fixes the frequency of excitation (w). In order to increase the force either the mass or its radius must be increased. Stress levels in the structure holding the mass quickly exceed the yield stress if the radius is increased very much. Increasing the mass increases the term −2ma, which reduces the modal displacement of the pipe end. The resultant reduction of the modal displacement requires more applied force, thus creating a circular situation which yields diminishing improvements in performance.

The servo-controlled hydraulic assembly 25 can be driven by a broad range of hydraulic-pressure waveforms, in order to achieve maximum efficiency in removing stuck objects. Variations in the geologic formations in which liners, casings, pump etc. are lodged require different strategies to achieve removal of the stuck device. In general, the winning strategy is determined by trial and error during the removal process.

Operating procedure

The first step in removing stuck liners, pumps, casing etc. involves attaching the elastic steel pipe 11 or rod to the piece to be removed. This is accomplished by inserting the "fishing tool" 18 to the inside of the stuck casing or liner 13. Pumps and drill bits already have a drill or pipe string 11 attached. Next, the vibrator 20 is attached to the free end of the pipe or drill rod 11, and an upward load is applied by the lifting block 16.

The hydraulic pump 80 may then be started and the accumulator 30 brought to working pressure (3000 p.s.i.). When the hydraulic system is actuated, it is driven at an appropriate resonant frequency which assures that the drill pipe 11 is maximally excited.

Examples of typical setups encountered when removing stuck pumps or liners would include;

(A) a 500 foot length of 2" diameter tubing held by sand, (B) a 2000 foot length of $2\frac{7}{8}$" diameter drill rod attached to a stuck drill bit, (C) 4000 foot length of $3\frac{1}{2}$" diameter rod attached to a stuck liner.

The longitudinal modes of vibration below 25 hertz in these three examples are:

| Example | Frequency (Hz) |
|---|---|
| A | 17.4 |
| B | 2.72, 6.6, 9.2, 10.8, 14.9, 19.1, 23.3 |
| The 9.2 Hz mode is harmful due to large vibrations induced in the derrick | |
| C | 1.92, 5.54, 11.7, 15.4, 19.4, 23.5 |

Any of the tabulated modes for A, B, and C, except those modes involving large displacement of the reaction mass (i.e., the 9.2 Hz mode in B), could be excited to remove the particular bound object.

The drill pipe 11 is excited for a few minutes at the maximum power level of the hydraulic system. This action acts to free the object through hysteresis heating of the adhesive substances and the mechanical vertical and radial forces. If this power level is not enough to overcome the adhesive forces an amount of high pressure nitrogen gas 43 is admitted to the accumulator bladder 42 to provide a transitory burst of vibratory energy to overcome the weakened adhesive forces. During this process an alternating upward force may be applied in conjunction with the resonant force by either changing the tension on the lifting block 16 or by combining an impulsive load with the resonant force in the hydraulic assembly 25.

To those skilled in the art to which this invention relates, many changes in construction and widely differing embodiments and applications of the invention will suggest themselves without departing from the spirit and scope of the invention. The disclosures and the descriptions herein are purely illustrative and are not intended to be in any sense limiting.

What is claimed is:

1. A method for recovering a stuck element from deep in a well, comprising, attaching the lower end of an elastic steel column to the upper end of the stuck element, the upper end of said column extending to the top of the well and thereabove, attaching said upper end of said column to a reaction mass vertically thereabove through vertically mounted compression spring means and, in parallel therewith, a vertically mounted servo-controlled hydraulic cylinder-piston assembly, sensing means for sensing the displacement of said upper end of said column relative to the earth in which the wall is located and developing therefrom a displacement signal, applying a substantially constant upward load to said reaction mass, so that as said stuck element is gradually freed the force applying said load is increased to keep said load constant, reciprocating the piston of said hydraulic cylinder under servo control to apply vertical vibration to the upper end of said column, while developing an electrical, pressure-differential signal corresponding to the pressure across said cylinder-piston assembly, adjusting said vertical vibration through said servo control in accordance with said displacement signal and said pressure differential signal, to seek and find an appropriate resonant frequency for said column in the range of $\frac{1}{2}$ Hz to 25 Hz, and maintaining said frequency at resonance.

2. The method of claim 1 wherein said step of maintaining said frequency at resonance includes keeping the displacement signal and pressure differential at a phase difference of approximately 90°.

3. The method of claim 1 wherein said sensing means for sensing the displacement comprises an accelerometer connected to said upper end of said column.

4. The method of claim 1 in which said reciprocating step comprises testing a selected resonant frequency under low force input conditions, determining whether that frequency is liable to result in damage from excess vibration at a higher force input corresponding to a resonance peak or is very unlikely to result in such damage, applying the higher force to raise the vibration to a resonance peak only if it is very unlikely to result in such damage, and otherwise going to a different selected resonant frequency and testing and determining as above until a resonant frequency suitable for application of said higher force is determined.

5. The method of claim 4, wherein the determining step includes sensing the acceleration of said reaction mass and whether it indicates significant movement of said reaction mass, or not, said higher force being applied only if there is no significant movement of said reaction mass.

6. The method of claim 1 wherein said reciprocating step comprises scanning the spectrum of resonant frequencies at low force input, determining which resonant frequencies are harmful modes, liable to result in damage from excess vibration at higher force inputs needed to raise the vibration to a resonance peak, and which resonant frequencies are safe, very unlikely to result in such damage, selecting a safe resonant frequency, and increasing the force input to an effective amount.

7. The method of claim 6, wherein the determining step includes sensing the acceleration of said reaction mass and whether it indicates significant movement of said reaction mass or not, said higher force being applied only if there is no significant movement of said reaction mass.

8. A method for recovering a stuck element from deep in a well, comprising, attaching the lower end of an elastic steel column to the upper end of the stuck element, the upper end of said column extending to the top of the well and thereabove, attaching said upper end of said column through an accelerometer to a reaction mass vertically thereabove through vertically mounted compression spring means and, in parallel therewith, a vertically mounted servo-controlled hydraulic cylinder-piston assembly, applying a substantially constant upward load to said reaction mass, so that as said stuck element is gradually freed the force applying said load is increased to keep said load constant, reciprocating the piston of said hydraulic cylinder under servo control to apply vertical vibration to the upper end of said column, measuring the instantaneous acceleration of said column with reference to the stationary walls of the well and developing an electrical acceleration signal thereby, electrically double-integrating the acceleration signal, filtering the doubly integrated signal to attenuate its low frequency noise, thereby giving a displacement signal, simultaneously detecting the instantaneous pressure across the hydraulic cylinder-piston assembly and developing an electrical pressure-difference signal therefrom, detecting the relative phase between said pressure difference signal and said displacement signal and generating an electrical signal proportional to the relative phase, being zero when the phase is 90°, which is the condition at resonance, electrically integrating the relative phase signal to produce a voltage control signal, and applying said voltage control signal to drive a voltage-controlled oscillator to cause the output of that oscillator to maintain said resonance.

9. Apparatus for recovering from deep in a well a stuck element to the upper end of which has been attached the lower end of an elastic steel column, the upper end of said column extending to the top of the well and thereabove, comprising a reaction mass vertically above said column, vertically mounted compression spring means and, in parallel therewith, a vertically mounted hydraulic cylinder-piston assembly connecting said reaction mass to said column through an accelerometer, support means for supporting and applying a constant upward load to said reaction mass, sensing means for sensing the displacement of said upper end of said column relative to the earth in which the well is located, and for generating a displacement signal therefrom, servo-control means connected to said hydraulic cylinder-piston assembly for reciprocating the piston of said assembly under servo control to apply vertical vibration to the upper end of said column, and feedback means connected to said accelerometer and to said servo-control means and employing the phase difference between a displacement signal from said sensing means and a pressure difference signal from said cylinder-piston assembly for adjusting said servo control to cause said assembly to seek and maintain an appropriate resonant frequency for said column in the range of ½ Hz to 25 Hz.

10. The apparatus of claim 9 wherein said feedback means includes means for maintaining a phase difference of approximately 90° between said displacement signal and said pressure difference signal.

11. The apparatus of claim 9 wherein said sensing means comprises an accelerometer connected to the upper end of said column.

12. The apparatus of claim 9 wherein said feedback means comprises a double integrator electrically connected to said accelerometer to develop a displacement signal, a pressure-differential transducer connected to the opposite sides of said piston and delivering a pressure-difference signal, and resonant controller means for receiving said displacement signal and said pressure-difference signal and for controlling frequency of delivery of pressurized fluid from said servo control means to said hydraulic-piston assembly on each side of said piston such as to maintain a phase difference of approximately 90° between the two said signals.

13. The apparatus of claim 9 having an accumulator secured to said reaction mass and connected hydraulically to said piston-cylinder assembly, a source of high pressure gas, and means for delivery, when desired, a pulse of high pressure gas from said source to said accumulator.

14. The apparatus of claim 9 having scanning means for scanning the resonant frequencies available at low force input, indicating means for determining which said frequencies are likely to be harmful and which ones are safe upon increasing the force input to a value producing peak resonance, and force increasing means for increasing said force input only at a safe such frequency.

15. Apparatus for recovering from deep in a well a stuck element to the upper end of which has been attached the lower end of an elastic steel column, the upper end of said column extending to the top of the well and thereabove, comprising a reaction means vertically above said column, vertically mounted compression spring means and, in parallel therewith, a vertically mounted hydraulic cylinder-piston assembly connecting said reaction mass to said column through an accelerometer, support means for supporting and applying a constant upward load to said reaction mass, servo-control means connected to said hydraulic cylinder-piston assembly for reciprocating the piston of said assembly under servo control to apply vertical vibration to the upper end of said column, and feedback means connected to said accelerometer and to said servo-control means and including measuring means for measuring the acceleration of said column with reference to the stationary walls of the well, first signal generating means for developing an electrical acceleration signal corresponding to said acceleration, double integrator means for electrically double-integrating the acceleration signal, filter means to filtering the doubly integrated signal to attenuate its low frequency noise, thereby giving a displacement signal, pressure sensing means for detecting the pressure across the hydraulic cylinder-piston assembly second signal generating means for developing an electrical, pressure-difference signal from said pressure, detecting means for detecting the relative phase between said pressure difference signal and said displacement signal, third signal generating means for generating an electrical signal proportional to the relative phase, said signal being zero when the phase is 90° which is the condition at resonance, single integrating means for electrically integrating the relative phase signal to produce a voltage control signal, and driving means for applying said voltage control signal to drive a voltage-controlled oscillator to cause the output of that oscillator to maintain said resonance at an appropriate resonant frequency for said column in the range of ½ Hz to 25 Hz.

* * * * *

UNITED STATES PATENT AND TRADEMARK OFFICE

CERTIFICATE OF CORRECTION

PATENT NO. : 4,574,888

DATED : March 11, 1986

INVENTOR(S) : Wayne V. Vogen

It is certified that error appears in the above-identified patent and that said Letters Patent are hereby corrected as shown below:

Column 3, line 34, "ring" should read --rig--.
Column 4, line 38, "hydraulically" should read --hydraulic--.
Column 8, line 58, "looks" should read --locks--.
Column 9, line 67, "substantially" should read --subsequently--.
Column 10, line 6, "pile" should read --pipe--.
Column 10, line 58, "-2ma" should read -- -2ma --.
Column 14, line 49, "reaction means" should read --reaction mass--.

Signed and Sealed this

*Twenty-ninth* Day of *July 1986*

[SEAL]

*Attest:*

*Attesting Officer*

DONALD J. QUIGG

*Commissioner of Patents and Trademarks*